US009108402B2

(12) United States Patent
Sudo et al.

(10) Patent No.: US 9,108,402 B2
(45) Date of Patent: Aug. 18, 2015

(54) INKJET PRINTER AND PRINTING METHOD

(71) Applicant: SEIKO EPSON CORPORATION, Tokyo (JP)

(72) Inventors: Naoki Sudo, Nagano (JP); Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/468,886

(22) Filed: Aug. 26, 2014

(65) Prior Publication Data

US 2015/0070419 A1 Mar. 12, 2015

(30) Foreign Application Priority Data

Sep. 12, 2013 (JP) ..... 2013-188986

(51) Int. Cl.
*B41J 29/38* (2006.01)
*B41J 2/045* (2006.01)

(52) U.S. Cl.
CPC ..... *B41J 2/0456* (2013.01)

(58) Field of Classification Search
USPC ..... 347/5, 14, 15, 19, 20, 40, 42, 47, 9
See application file for complete search history.

(56) References Cited

U.S. PATENT DOCUMENTS

| | | | | |
|---|---|---|---|---|
| 7,591,525 | B2 * | 9/2009 | Arazaki | 347/19 |
| 7,673,958 | B2 * | 3/2010 | Heiles et al. | 347/19 |
| 8,123,321 | B2 * | 2/2012 | Mizutani | 347/15 |

FOREIGN PATENT DOCUMENTS

| | | | |
|---|---|---|---|
| JP | 2006-076086 | A | 3/2006 |
| JP | 2006-173929 | A | 6/2006 |

* cited by examiner

*Primary Examiner* — Anh T. N. Vo
(74) *Attorney, Agent, or Firm* — Global IP Counselors, LLP

(57) ABSTRACT

An inkjet printer includes a print head, a nozzle position and a print control section. The print head includes a plurality of nozzles to eject ink. The nozzle position specifying section is configured to specify a position of a first nozzle of the plurality of nozzles that exhibits defective ejection of the ink. The print control section is configured to eject the ink from the plurality of nozzles based on image data. The print control section is configured to determine a density of second pixels, which are positioned adjacent to first pixels to be printed by the first nozzle that was specified, and a density of third pixels, which are positioned adjacent to the second pixels except the first pixels, based on the image data, and to correct to increase the density of the second pixels and to reduce the density of the third pixels.

6 Claims, 13 Drawing Sheets

SPECIFIED IMAGE DATA

| | | | | |
|---|---|---|---|---|
| 255 | 255 | 0 | 255 | 0 |
| 100 | 255 | 255 | 255 | 255 |
| 100 | 255 | 255 | 255 | 255 |
| 100 | 255 | 255 | 255 | 255 |
| 100 | 255 | 0 | 255 | 255 |
| 100 | 255 | 255 | 255 | 100 |
| 100 | 255 | 255 | 255 | 100 |
| 100 | 0 | 0 | 255 | 100 |
| 100 | 0 | 255 | 255 | 100 |
| 100 | 10 | 255 | 255 | 100 |
| 100 | 3 | 255 | 255 | 100 |
| 100 | 50 | 255 | 255 | 100 |
| P3 | P2 | P1 | P2 | P3 |

HALFTONE

| | | | | |
|---|---|---|---|---|
| 2 | 0 | 0 | 2 | 0 |
| 2 | 2 | 0 | 2 | 2 |
| 2 | 2 | 2 | 2 | 2 |
| 2 | 2 | 0 | 2 | 2 |
| 2 | 2 | 0 | 2 | 2 |
| 0 | 2 | 2 | 2 | 2 |
| 2 | 2 | 2 | 2 | 0 |
| 0 | 2 | 0 | 2 | 2 |
| 2 | 0 | 0 | 2 | 0 |
| 0 | 0 | 2 | 2 | 2 |
| 2 | 0 | 2 | 2 | 0 |
| 2 | 0 | 0 | 2 | 2 |

| | | | | |
|---|---|---|---|---|
| 2 | 2 | 2 | 2 | 2 |
| 2 | 2 | 2 | 2 | 2 |
| 2 | 2 | 2 | 2 | 2 |

100%

| | | | | |
|---|---|---|---|---|
| 0 | 2 | 2 | 2 | 2 |
| 0 | 2 | 0 | 2 | 2 |
| 0 | 0 | 0 | 2 | 2 |

60%

Fig. 11A
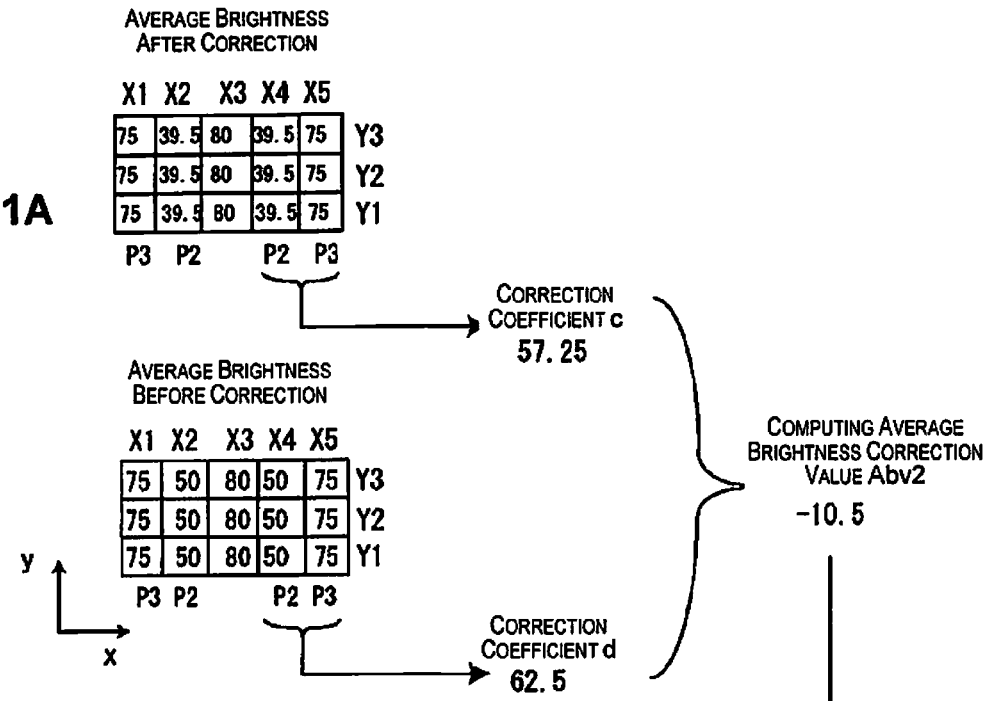
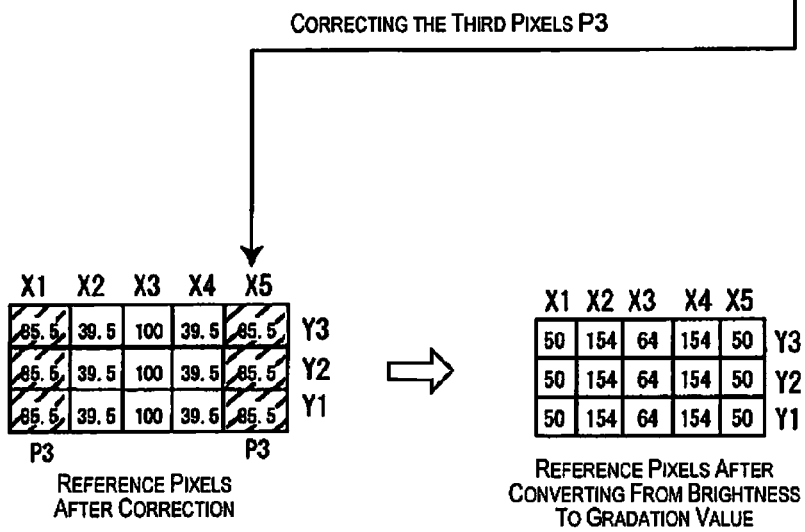
Fig. 11B
Fig. 11C

INKJET PRINTER AND PRINTING METHOD

CROSS-REFERENCE TO RELATED APPLICATIONS

This application claims priority to Japanese Patent Application No. 2013-188986 filed on Sep. 12, 2013. The entire disclosure of Japanese Patent Application No. 2013-188986 is hereby incorporated herein by reference.

BACKGROUND

1. Technical Field

The present invention relates to an inkjet printer and a printing method.

2. Related Art

A printer is defined as an output device that provides a hard copy record of data as a main form for a discrete graphic character string belonging to one or plurality of predetermined character sets (JIS X0012-1990). In many cases, the printer can be used as a plotter.

The plotter is defined as an output device that directly provides hard copy record of data in a form of two-dimension drawing in a removable medium (JIS X0012-1990).

An inkjet printer is defined as a nonimpact printer, and characters are formed on a paper by ejecting ink particles or small ink droplets (JIS X0012-1990). It is a form of dot printer, and characters or images expressed by a plurality of dots formed by ejecting the ink particles or the small ink droplets are printed.

In the inkjet printer, there is a case that a dot omission occurs when the ink from nozzles is not ejected due to a clogging, etc., or when the ink is not ejected in a proper trajectory. Here, the dot omission is defined as the occurrence of the deterioration of image quality since the halftone dots are not printed in a proper position and a space between halftone dots are expanded. Also, in the field of inkjet printer, the clogging is a phenomenon that an ink ejecting hole of a head is clogged in the inkjet printer (JIS Z8123-1:2013). Hereinafter, the aforementioned ink ejecting hole or ejecting hole is referred to as a nozzle. Further, it discloses that a nozzle that does not eject the ink or does not eject the ink in a proper trajectory is referred to as a defective nozzle.

Further, the halftone is defined as an image formed by dots in number of screen lines, sizes, shapes, or different densities. The halftone is generated by dithering, error diffusion, etc. The halftone dot is defined as an individual element configuring a gradation. As a halftone dot, various shapes such as a square shape, circular shape, oval shape, etc. may be formed. Hereinafter, it discloses that the halftone dot is simply referred to as dot.

The invention that makes a dot omission less noticeable by controlling positions of dots surrounding a portion where a dot omission occurs is disclosed (e.g., see Japanese Laid-open Patent Application Publication No. 2006-173929).

SUMMARY

When the positions of the dots are changed, the density unevenness occurs due to the overlapping of the dots each other. The density unevenness is a phenomenon that the densities of colors are changed between a position where the dots are overlapped and a position where the dots are not overlapped and streaks, etc. are visually confirmed. When the density unevenness occurs, the deterioration of an image occurs so that it is not desirable.

The present invention is to solve at least one of the aforementioned objects, and to provide an inkjet printer or a printing method that makes a dot omission less noticeable and is possible to realize an improvement of printing quality more than before.

An inkjet printer according to one aspect includes a print head, a nozzle position and a print control section. The print head includes a plurality of nozzles to eject ink. The nozzle position specifying section is configured to specify a position of a first nozzle of the plurality of nozzles that exhibits defective ejection of the ink. The print control section is configured to eject the ink from the plurality of nozzles based on image data. The print control section is configured to determine a density of second pixels, which are positioned adjacent to first pixels to be printed by the first nozzle that was specified, and a density of third pixels, which are positioned adjacent to the second pixels except the first pixels, based on the image data, and to correct to increase the density of the second pixels and to reduce the density of the third pixels.

When there exists a nozzle that exhibits defective ejection of the ink, a dot omission occurs. First, a position of the first nozzle that exhibits defective ejection of the ink is specified by the nozzle position specifying section. Next, the print control section controls to increase the density of the second pixels which are positioned adjacent to the first pixels to be printed by the first nozzle that was specified. Therefore, the halftone dots printed by the second pixels, in which the density was increased, overlap to a portion where the dot omission occurs so that it makes the dot omission less noticeable.

On the other hand, it may presume that the density unevenness occurs due to the overlapping of the halftone dots in response to the second pixels and the vicinity of the halftone dots when the printing is performed by the second pixels in which the density was increased. Therefore, the density for the third pixels, which are positioned adjacent to the second pixels except the first pixels, is reduced. Therefore, the density in the halftone dots printed by the third pixels is reduced so that the density unevenness can be suppressed.

Here, the printer includes a serial printer or a line-type printer. The serial printer is defined as a printing device that prints one character at once (JIS X0012-1990). Regarding the serial printer, the phrase "one character" is defined as to be a phrase "a character or an image expressed by a plurality of dots corresponding to one character".

As the line-type printer, it is a printing device that prints one line of characters as a unit (JIS X0012-1990). Regarding the line-type printer, the phrase "one line of characters" is defined as to be a phrase "characters or images expressed by a plurality of dots corresponding to one line of characters".

The printer head includes at least a head for the serial printer and a head for the line-type printer. As the head for the serial printer, the head is used for the serial printer. As the head for the line-type printer, the head is used for the line-type printer.

Further, the inkjet printer is preferably the line-type printer, the second pixels are preferably included in a pixel line printed by the second nozzle, which is positioned adjacent to the first nozzle in a direction intersecting a feed direction of a print substrate, and the third pixels are preferably included in a pixel line printed by the third nozzle, which is positioned adjacent to the second nozzle in a direction intersecting the feed direction of the print substrate.

With such configuration described above, in the line-type printer, the dot omission and the density unevenness that sequentially occur in the feed direction of a print substrate can be made less noticeable.

Here, the feed direction is defined as a direction of a geometric vector according to the movement of the print substrate when the print substrate and the head are faced each other.

Also, the inkjet printer is preferably a serial printer, the second pixels are preferably included in a pixel line printed by the third nozzle, which is positioned adjacent to the first nozzle in a feed direction of a print substrate, and the third pixels are preferably included in a pixel line printed by a fourth nozzle, which is positioned adjacent to the third nozzle in the feed direction of the print substrate With such configuration described above, in the serial printer, a dot omission and density unevenness that continuously occur in a direction intersecting with the feed direction of the print substrate can be made less noticeable.

Further, the print control section is preferably configured to perform correction of the density for every predetermined number of pixels included in the image data.

With such configuration described above, the present invention can be applied in every predetermined area of the image data, and the image quality deterioration can be flexibly corrected.

Further, the print control section is preferably configured to correct the density of the second pixels and the density of the third pixels to become a condition that a difference between an average brightness of the predetermined number of pixels before the correction and an average brightness of the predetermined number of pixels after the correction when the first pixels are defined as high brightness is less than a predetermined range.

With such configuration described above, the image quality deterioration due to the dot omission can be suppressed while the brightness change by the correction is suppressed at the minimum.

The technical ideas according to the present invention are realized by not only the inkjet printer, but it may be realized by other things. It may be realized as the invention of the method (printing method) providing the steps that correspond to the features of the inkjet printer according to the aforementioned any of the aspects. Further, the inkjet printer may be realized by a single device or may be realized by a combination of plural devices. When the configuration of the inkjet printer is realized by the plural devices, these devices can be called as an inkjet printing or an inkjet system.

BRIEF DESCRIPTION OF THE DRAWINGS

Referring now to the attached drawings which form a part of this original disclosure:

FIGS. 11A to 11C are diagrams explaining a density correction processing;

DETAILED DESCRIPTION OF EXEMPLARY EMBODIMENTS

Hereinafter, the present invention will be explained in reference to the drawings according to the following order: 1. First embodiment; 2. Second embodiment; and 3. Various Modified embodiments:

1. First Embodiment

Figure 1:
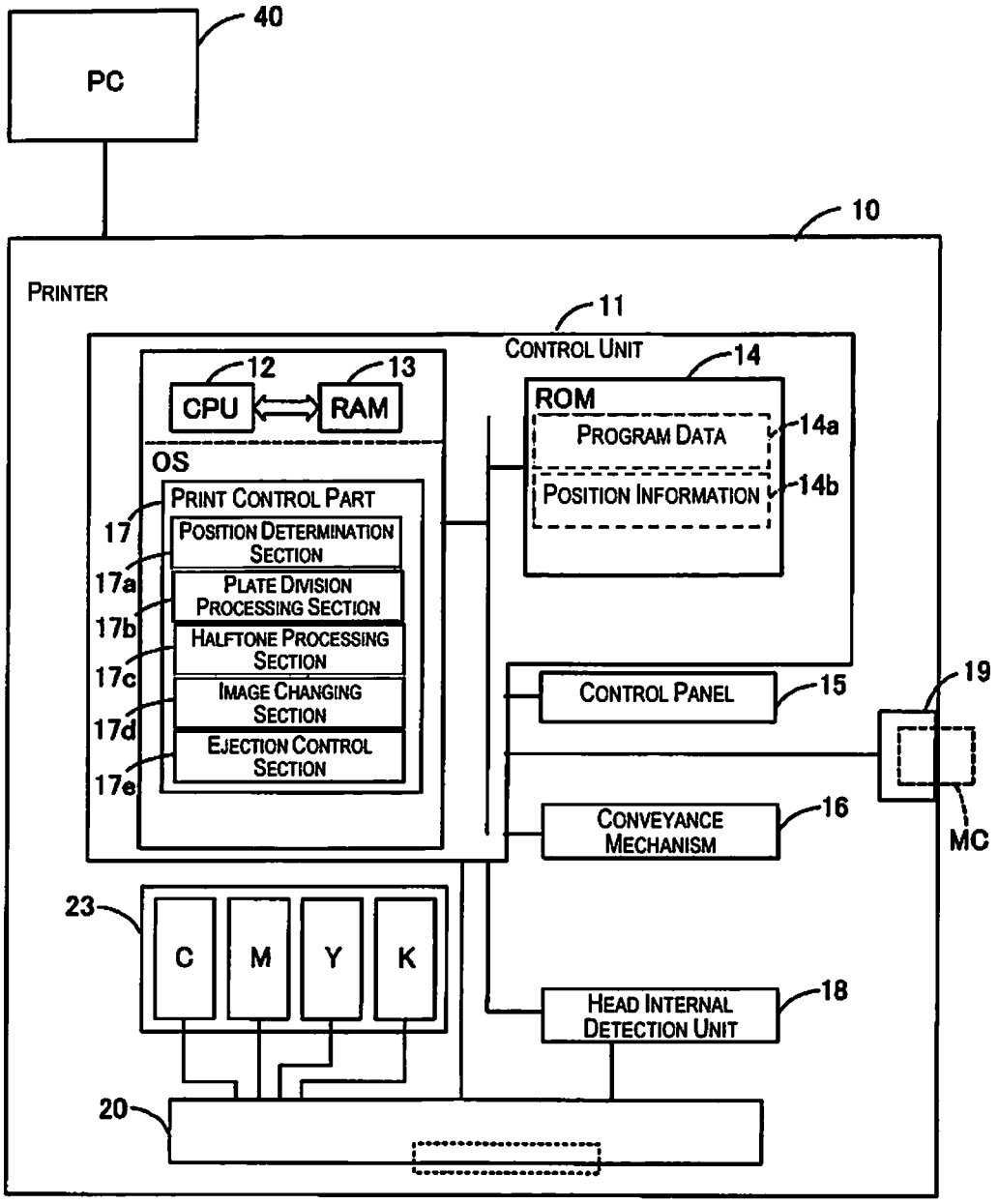
FIG. 1 is a diagram schematically showing a hardware configuration and a software configuration.
Figure 2:
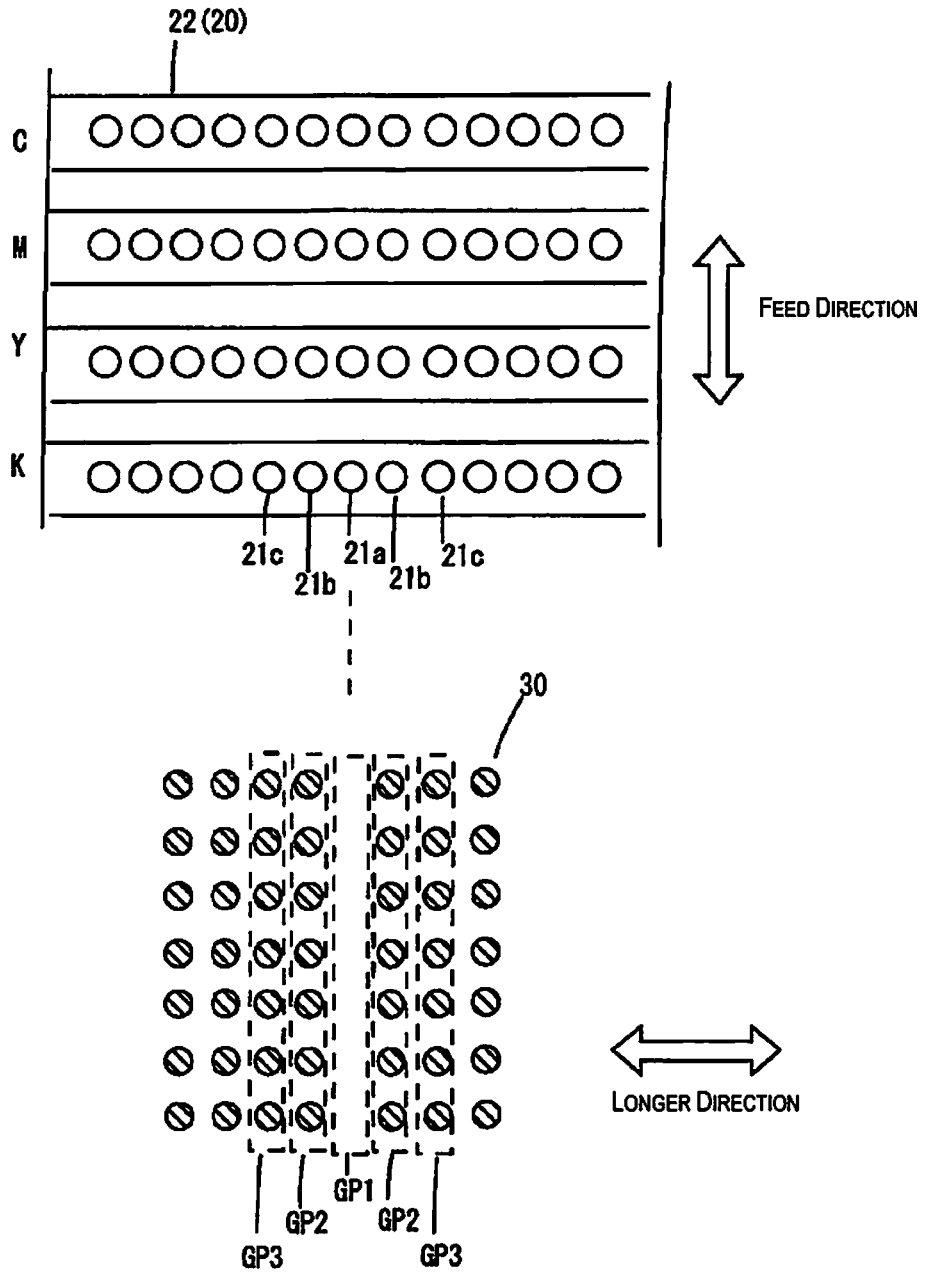
FIG. 2 is a diagram exemplifying a part of each nozzle array in each of CMYK in an ejecting hole face 22 of a print head 20, and dots on a print substrate printed by the nozzle arrays.

FIG. 1 schematically shows a hardware configuration and a software configuration according to the present embodiment. FIG. 2 exemplifies a part of each nozzle array in each of CMYK in an ejecting hole face 22 (surface that openings of a nozzle 21 are formed) of a print head 20, and dots on a print substrate printed by the nozzle arrays.

In FIG. 1, a PC (personal computer) 40 and a printer 10 are shown. The printer 10 corresponds to an inkjet printer. A system including the PC 40 and the printer 10 may be counted as a printing device or an inkjet printing. The printer 10 is provided with a control unit 11 to control a print processing. In the control unit 11, a CPU 12 executes a firmware to control the own device by developing program data 14*a*, which is stored in a ROM 14, etc., in a RAM 13 and performing operation in accordance with the program data 14*a* under the OS. The firmware is a program to execute functions of a print control section 17, etc. by the CPU 12.

Further, the print control section 17 is provided with each function of a position determination section 17*a*, a plate division processing section 17*b*, a halftone processing section 17*c*, an image changing section 17*d*, an ejection control section 17*e*, etc. These functions will be described later.

The print control section 17 inputs designated image data from a storage medium, etc. inserted from exterior into, for example, the PC 40 or the printer 10, and generates a halftone from the designated image data. The storage medium inserted from exterior of the printer 10 is defined as, for example, a memory card MC, and the memory card MC is inserted into a slot section 19 formed in a case of the printer 10. Further, the print control section 17 can input designated image data from various external devices such as a scanner, a digital camera, a mobile terminal, a server that is connected via a network, etc. that are wirelessly or wiredly connected to the printer 10.

Here, an image is defined as pictures, paintings, illustrations, drawings, characters, etc. that are visually seen by human eyes, and to properly express original shapes, colors, and perspectives. Further, the term "image data" means digital data to express an image. The term "image data" corresponds to vector data, bit map image, etc. The vector data is defined as image data to be stored as a set of instruction and parameter to express geometric configuration such as a straight line, circle, circular arc, etc. The bit-mapped image is defined as image data described by arrays of pixels. A pixel is defined as a minimum element configuring an image in which a color or brightness is individually assigned. Hereinafter, specifically, the image data expressing any designated image to be printed in the printer 10 by the user is called as designated image data.

The printer 10 is provided with an ink cartridge 23 in each of various inks. In the example of FIG. 1, the ink cartridge 23 corresponding to each ink of cyan (C), magenta (M), yellow (Y), black (K) is provided. However, the specific type of liquid and numbers used in the printer 10 are not limited to the above description, and for example, various inks and liquid such as light cyan, light magenta, orange, green gray, light gray, white, metallic ink, pre-coat liquid, etc. can be used. Also, the printer 10 is provided with a print head 20 to eject inks, which are supplied from each of the ink cartridges 23, from a plurality of nozzles 21. Further, the inks included in the ink cartridges 23 may be a pigment ink or a dye ink. Also, it may be a mixture of these inks.

The print head 20 according to the first embodiment is a head for line-type printer in an elongated shape. Accordingly, the printer 10 is a line inkjet printer. For example, the print head 20 is fixed on a predetermined position in the printer 10. In the print head 20, a direction that intersects with a direction of moving a print substrate (feed direction) is a longer direction, and the nozzle arrays having the plurality of nozzles 21 are provided in the longer direction. It is possible to express the longer direction as a nozzle array direction. Here, the term "intersect" means orthogonal. The intersect called in the present specification means not only precise angle (90°), but it also means to include an angle error approximately in a range permissible for device quality. The nozzle array has a length corresponding to at least a width of a printable area on the print substrate within the width of the print substrate in the aforementioned longer direction. Also, the nozzle array is provided in each of ink types used in the printer 10.

The print substrate is defined as a material to store a print image. The shape is generally a rectangle shape, but there are a circular shape (e.g., optical disk such as CD-ROM, DVD, etc.), a triangle shape, quadrangle shape, polygonal shape, etc., and it includes at least product types of paper/paper board and processed product described in Japanese Industrial standards "JIS P0001:1998 paper/paper board and pulp terms".

The print control section 17 generates a drive signal to drive the print head 20, the conveying mechanism 16, etc. based on the aforementioned halftone. The print head 20 is to eject the ink to the print substrate. As shown in FIG. 2, each nozzle array in each CMYK of the print head 20 is lined in parallel along the aforementioned feed direction. The nozzle density (numbers/inches of nozzles) in the aforementioned longer direction in each nozzle array of each CMYK corresponds to a printing resolution (dpi) in the aforementioned longer direction of the print head 20. Therefore, the dots of C, M, Y, K are overlapped to the print substrate by ejecting the ink from each color of the nozzle array in the print head 20 so as to print a desired image.

In FIG. 2, as a matter of practical convenience, the dots in the nozzle array of K are shown. In the nozzle array, the nozzle (first nozzle) 21*a* is a defective nozzle that exhibits defective ejection of ink. Here, nozzles 21*b*, 21*b*, which are positioned adjacent to the nozzle 21*a* in a direction (longer direction) intersecting with the feed direction, are defined as the second nozzle. Further, nozzles 21*c*, 21*c*, which are positioned adjacent to the second nozzles 21*b* in the longer direction, are defined as the third nozzle.

Reference numeral 30 is referred to an imaging section that the dots are formed to the print substrate. The imaging section 30 includes an imaging section GP1 that the dots are formed by the first nozzle 21*a*, imaging sections GP2 that the dots are formed by the second nozzles 21*b*, and imaging sections GP3 that the dots are formed by the third nozzles 21*c*. As described above, the first nozzle 21*a* is the defective nozzle so that the dots are not formed in the imaging section GP1 and the color on the surface of the print substrate becomes exposed, that is, a dot omission occurs. The dot omission is sequentially formed on the print substrate along the feed direction of the print substrate.

Also, the print head 20 is capable of ejecting dots in a plurality of sizes that the ink amount per dot is respectively different (small dot, medium dot, large dot). In the present embodiment, in the normal print processing, the printer 10 prints dots in the medium dot size.

By the way, each nozzle array in each of CMYK may be configured by only one line of nozzle array that the nozzles 21 are lined along the aforementioned longer direction, or it may be configured by a plurality of nozzle arrays that are parallel to each other and shift with a predetermined pitch in the aforementioned longer direction (that is, configuration in a zigzag manner).

Figure 3A:
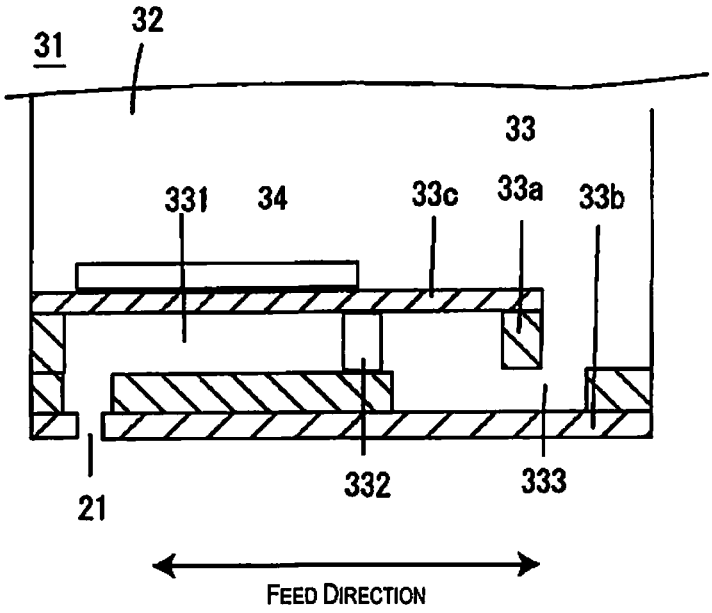
FIGS. 3A and 3B are diagrams explaining an inside of a head 31.
Figure 3B:
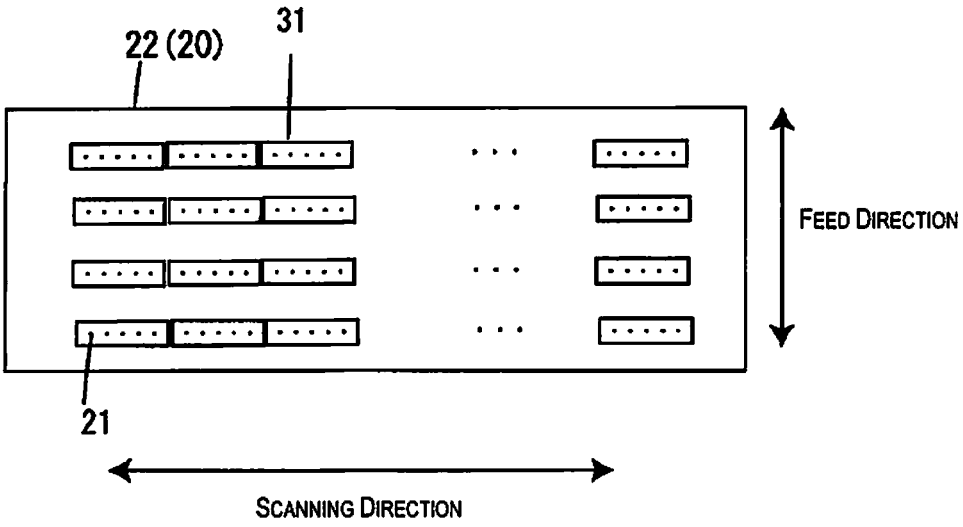

Further, the nozzle array of each color of the print head 20 is configured by combining the heads 31 provided with the predetermined nozzles 21. FIGS. 3A and 3B are diagrams explaining an inside of a head 31. As shown a cross-sectional diagram in FIG. 3A, the head 31 is provided with a case 32, a channel unit 33, and a pressure generating element 34. The case 32 is a member to store and fix a pressure generating element, etc., and it is made by, for example, non-conductive resin material of epoxy resin, etc.

As shown in FIG. 3B, the print head 20 is provided with such heads 31 in which the nozzles 21 formed in the channel unit 33 are arranged toward the same surface.

The channel unit 33 is provided with a channel forming substrate 33*a*, a nozzle plate 33*b*, and a diaphragm 33*c*. In one side of the surfaces in the channel forming substrate 33*a*, the nozzle plate 33*b* is bonded, and the diaphragm 33*c* is bonded on the other side of the surfaces. In the channel forming substrate 33*a*, an opening portion or a groove to become a pressure chamber 331, an ink supply passage 332, and a common ink chamber 333 is formed. The channel forming substrate 33*a* is made by, for example, a silicon substrate. Also, a nozzle plate 33*b* is provided with a plurality of nozzles 21. The nozzle plate 33*b* is made of a plate member having conductivity, for example, thin metal plate. Also, the nozzle plate 33*b* becomes a ground potential which is connected to a ground wire.

The pressure generating element 34 is an example of an electromechanical conversion element, and when a drive signal COM is applied, it expands and contracts in the longer direction so that the pressure change is applied to the liquid in the pressure chamber 331. By using the pressure change, the ink droplets can be ejected from the nozzles 21. The pressure generating element 34 is configured by, for example, well-known piezoelectric element. Since the diaphragm 33*c*, an adhesive layer, etc. are intervened, it becomes in a state that the pressure generating element 34 and the nozzle plate 33*b* are electrically insulated.

Figure 4:
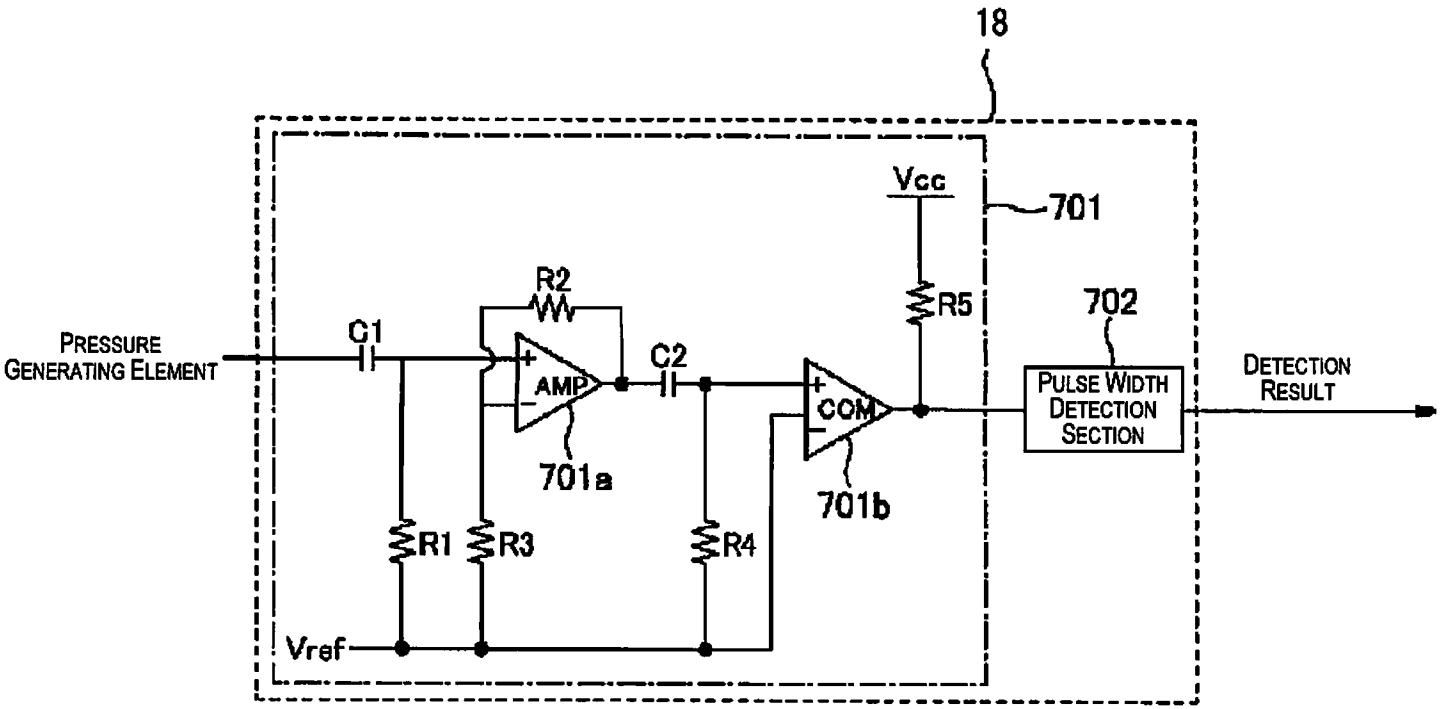
FIG. 4 is an explanatory diagram showing a configuration of a head internal detection unit 18.
Figure 5A:
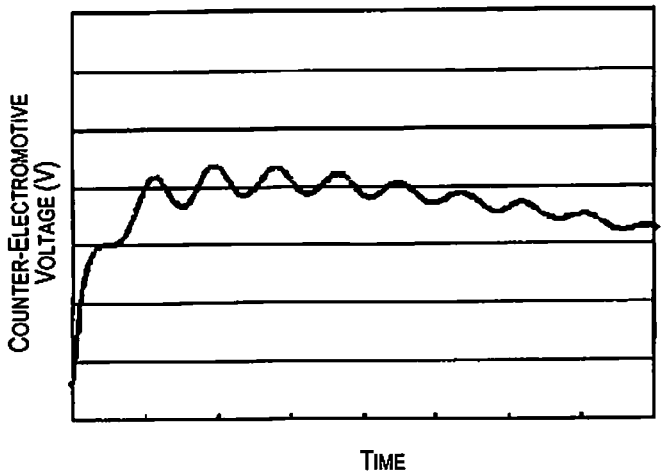
FIGS. 5A to 5C are explanatory diagrams showing a principle to detect a defective nozzle.
Figure 5B:
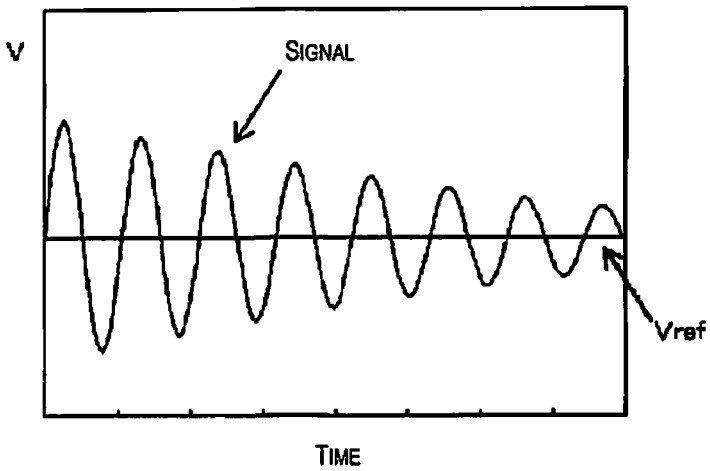
Figure 5C:
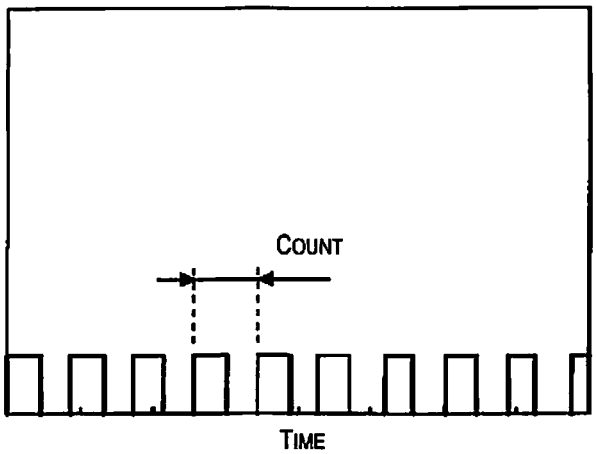

The head internal detection unit 18 detects a position of a defective nozzle based on a residual vibration generated in the pressure generating element 34. FIG. 4 is an explanatory diagram showing a configuration of the head internal detection unit 18. Further, FIGS. 5A to 5C are explanatory diagrams showing a principle to detect a defective nozzle. As shown in FIG. 4, the head internal detection unit 18 is provided with an amplification section 701 and a pulse width detection section 702.

A principle that the head internal detection unit 18 detects a defective nozzle will be explained. When the drive signal COM outputted from the print control section 17 is applied to the corresponded pressure generating element 34, the diaphragm 33*c* connected with the pressure generating element 34 is vibrated. The vibration of the diaphragm 33*c* does not stop immediately so that a residual vibration is generated. Therefore, the pressure generating element 34 vibrates and outputs a signal (counter-electromotive voltage, FIG. 5A) in response to the residual vibration.

FIG. 5A is a diagram showing a signal that is outputted by the pressure generating element 34 in response to the residual vibration. An unique voltage waveform (vibration pattern) in response to the respective ink state is outputted since the frequency characteristic is different depending on the ink state in the head (normal, mixing of bubbles, viscosity increase of ink, adhesion of paper powder). Therefore, when a signal from the pressure generating element 34 is inputted to an amplification section 701 of the head internal detection unit 18, the low-frequency components included in the signal are excluded by the high-pass filter configured by a capacitor C1 and a resistor R1, and it is amplified in the predetermined amplification factor by the operational amplifier 701*a*.

FIG. 5B is a diagram showing a signal, which is after the output of the operational amplifier 701*a* passed through the high-pass filter configured by a capacitor C2 and a resistor R4, and a reference voltage Vref. Next, the output of the operational amplifier 701*a* is passed through the high-pass filter configured by the capacitor C2 and the resistor R4 so that it is converted to a signal to be vibrated vertically around the reference voltage Vref. That is, it is the signal to be inputted to the comparator 701*b*.

FIG. 5C is a diagram showing an output signal from the comparator 701*b*. That is, it is the signal to be inputted to a pulse width detection section 702. It is compared with the reference voltage Vref by the comparator 701*b*, and it is binarized by whether or not it is higher than the reference voltage Vref. Hereinafter, such signal that was binarized is disclosed as a pulse.

When a pulse shown in FIG. 5C is inputted, the pulse width detection section 702 resets a count value in the rising point of the pulse, and after that, the count value is incremented in every clock signal, and the count value in the next rising point of the pulse is outputted to the print control section 17. The print control section 17 can detect a cycle of the signal outputted from the pressure generating element 34 based on the count value outputted from the pulse width detection section 702, that is, based on the detection result outputted from the head internal detection unit 18. These processes are sequentially made for the pressure generating element 34 corresponding to each nozzle so that the frequency characteristic of each pressure generating element 34 can be detected. Such detected frequency characteristic is deferent depending on an ink state (normal, mixing of bubbles, viscosity increase of ink, adhesion of paper powder) in the inside of the head 31. That is, a vibration pattern of a residual vibration is different depending on an ink state (normal, mixing of bubbles, viscosity increase of ink, adhesion of paper powder) in the inside of the head 31.

As described above, the head internal detection unit 18 outputs the vibration pattern having the frequency characteristic in response to the residual vibration so that the print control section 17 can determine the ink state in the head (whether it is normal, or whether the defect occurs due to the mixing of bubbles, or whether the defect occurs due to the viscosity increase of ink, or whether the defect occurs due to a foreign object such as paper powder, etc. adhering to the nozzle 21). That is, by connecting the head internal detection unit 18 to each nozzle 21, the head internal detection unit 18 can figure out the state of each nozzle as position information. The print control section 17 (position determination section 17*a*) functions as a nozzle position specifying section based on the aforementioned position information.

The conveying mechanism 16 is provided with a motor (not shown in the drawings), rollers (not shown in the drawings), etc. and a print substrate is conveyed along the aforementioned feed direction by the drive control of the print control section 17. When the ink is ejected from each nozzle 21 of the print head 20, the ink is adhered onto the print substrate while conveying so that an image is reproduced on the print substrate based on the aforementioned halftone.

The printer 10 is further provided with a control panel 15. The control panel 15 includes a display section (e.g., liquid crystal panel), a touch panel formed in the display section, various buttons, and keys, and it receives inputs from the user, and it displays necessary UI (user interface) screens on the display section.

Figure 6:
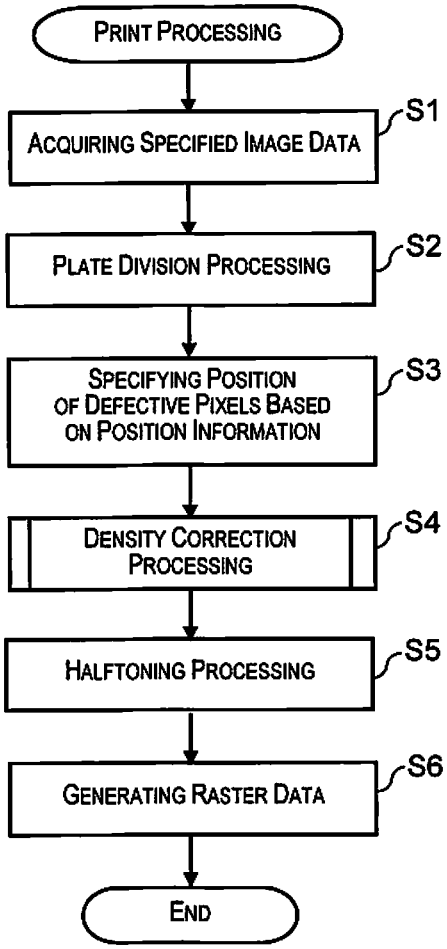
FIG. 6 is a flowchart showing printing control processes to print an image performed under the aforementioned configuration.
Figure 7A:
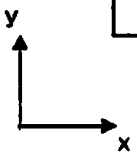
FIGS. 7A and 7B are diagrams showing image data to perform processing by a printer 10.
Figure 7B:
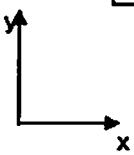

FIG. 6 is a flowchart showing printing control processes to print an image performed under the aforementioned configuration. FIGS. 7A and 7B show image data to perform processing by the printer 10. In FIGS. 7A and 7B, as a matter of practical convenience, it shows only a part of data including pixels that are printed by the first nozzle 21*a* (defective nozzle).

In Step S1, when the print control section 17 receives a printing instruction of an image from the user through the control panel 15, the designated image data is acquired. The print control section 17 acquires the designated image data from any information sources such as the PC 40, a storage medium, an external device, etc.

Other than that, it is possible that the user externally controls the printer 10 to perform a printing instruction of an image by controlling a remotely-operable mobile terminal, etc. Also, the user can request various print conditions such as number of print copies, paper size, printing resolution in the aforementioned feed direction, etc. to the printer 10 with the printing instruction.

In Step S2, the plate division processing section 17*b* performs a plate division processing to an input image. That is, the color coordinate system of the designated image data ID2 is converted to the ink color coordinate system that the printer 10 uses. For example, when the designated image data expresses the color of each pixel in the RGB value, the ink amount data is obtained by converting the RGB value in each pixel to the gradation value (CMYK value) of each of CMYK. Such color conversion processing can be executed by reviewing any color conversion look-up table. In FIG. 7A, the pixels of the designated image data are expressed by any of 0 to 255 (256 gradation) in each color of CMYK.

In Step S3, the position determination section 17*a* specifies the positions of the pixels, which are printed by the defective nozzle (the first nozzle) 21*a* for the designated image data (that is, the image data before the halftone), based on the position information supplied from the head internal detection unit 18. Hereinafter, the pixels printed by the first nozzle 21*a* are simply disclosed as defective pixels P1. That is, in this step, the position determination section 17*a* specifies the positions of the defective pixels P1 for the designated image data specified by the gradation value. Before and after the halftone processing, when the number of pixels in the designated image data and the number of pixels in the halftone are the same, the position determination section 17*a* specifies the positions of the defective pixels P1 depending on the position of the defective nozzle 21*a* in the nozzle array.

On the other hand, before and after the halftone processing, when the number of pixels in the designated image data and the number of pixels in the halftone are different, the position determination section 17*a* specifies the positions of the defective pixels P1 depending on the relationship between the position of the defective nozzle 21*a* in the nozzle array and the number of pixels that are changed.

In Step S4, the image changing section 17*d* performs the density correction for the designated image data. The density correction processing performs to correct the density for the pixels, which are the first pixel adjacent to the defective pixels P1, to be increased, and to correct the density for the pixels, which are the second pixel adjacent to the defective pixels, to be reduced. Here, the phrase "first pixel adjacent to" means the pixels which are positioned in the first pixel adjacent to the defective pixels P1 in x-direction. Hereinafter, such pixels are disclosed as the second pixels P2. In FIG. 7A, the second pixels P2 are respectively positioned in both ends of the first pixels P1 in the x-direction. Also, the second pixels P2 are included in pixel lines that are sequenced in the y-direction. Also, the phrase "second pixel adjacent to" means the pixels which are positioned in the second pixel adjacent to the defective pixels P1 in x-direction. Hereinafter, such pixels are disclosed as the third pixels P3. In FIG. 7A, the third pixels P3 are positioned in an opposite side of the defective pixels P1 with respect to the second pixels P2 in the x-direction. Further, the third pixels P3 are included in the pixel lines that are sequenced in the y-direction.

This is one example that the positions of the pixels, which are changed in the dot size, are defined as to be the first pixel and the second pixel adjacent to the defective pixels.

Figure 8:
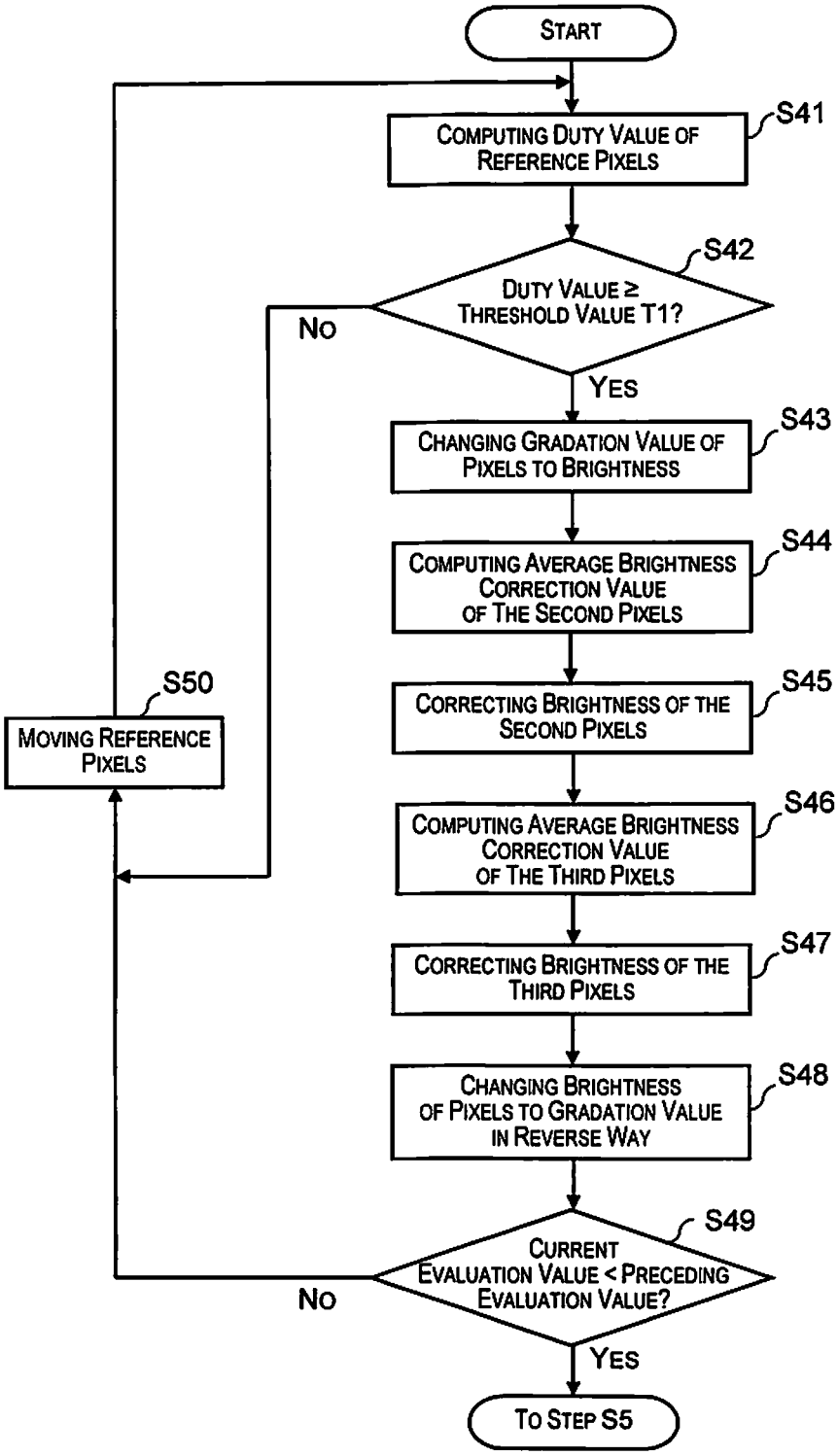
FIG. 8 is a flowchart showing a processing performed in Step S4 of FIG. 6 in detail.

FIG. 8 is a flowchart showing a processing performed in Step S4 of FIG. 6 in detail. Also, FIGS. 9A to 9C, FIGS. 10A to 10C, and FIGS. 11A to 11C are a diagram explaining a density correction processing.

Figure 9A:
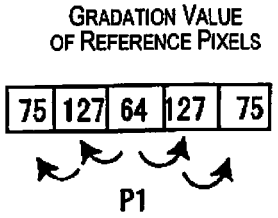
FIGS. 9A to 9C are diagrams explaining a density correction processing.

In the first embodiment, as one example of the density correction processing, as shown in FIG. 9A, the brightness change that occurs in actual dots due to the dot omission is defined as an error, and by reflecting the error to the vicinity of the pixels (P2, P3), the density of the reference pixels including the defective pixels P1 is corrected.

Figures 10A, 10B, 10C:
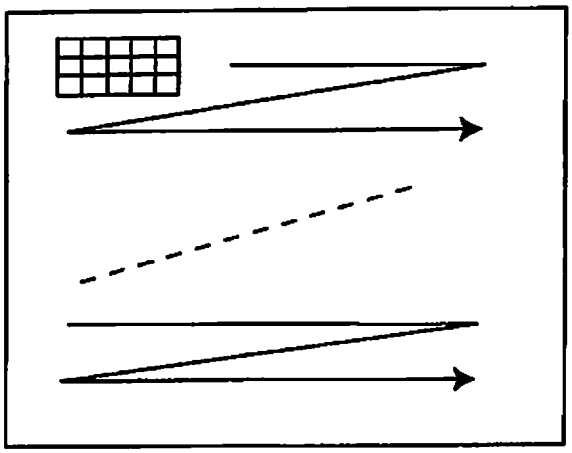
FIGS. 10A to 10C are diagrams explaining a density correction processing.

In Step S41 of FIG. 8, the image changing section 17*d* acquires the Duty value of the reference pixels including the defective pixels P1 as shown in FIG. 10A. Here, the Duty value is to acquire the density in unit area in the designated image data, and is computed depending on the gradation value of the monochromatic dots included in the reference pixels. For example, the Duty value is 100% when the gradation value of all of the pixels configuring the reference pixels is 255 as shown in FIG. 10B, and the Duty value is 0% when the gradation value of all of the pixels configuring the reference pixels is 0 as shown in FIG. 10C. The gradation value is changed between 0% to 100% depending on a combination of the gradation values in each pixel.

When the density of the reference pixels is more than or equal to the threshold value T1 (Step S42: YES), in Step S43, the image changing section 17*d* changes from the gradation value of each pixel included in the reference pixels to the brightness. As a changing method from the gradation value to the brightness, a look-up table that records a correspondence relationship between the gradation value and the brightness is preliminary recorded, and the image changing section 17*d* may review it. Other than that, by using the well-known conversion equation, the image changing section 17*d* may convert from the gradation value to the brightness. Generally, as the gradation value is higher, the brightness becomes lower.

In Steps S44 and S45, the image changing section 17*d* performs the first density correction to the second pixels P2 which are positioned adjacent to the defective pixels P1. In the first density correction, the brightness of the second pixels P2 is reduced based on the brightness change (error) of the defective pixels P1, and as a result, the density of the second pixels P2 is increased.

First, in Step S44, the image changing section 17*d* computes an average brightness correction value Abv1 as a correction value to correct the brightness of the defective pixels P1 and the second pixels P2. Here, the average brightness correction value Abv1 is defined as a difference (error) of the average brightness, which occurs due to the dot omission, reflected in 2 of the second pixels P2 that are positioned adjacent to the defective pixels P1.

Figure 9B:
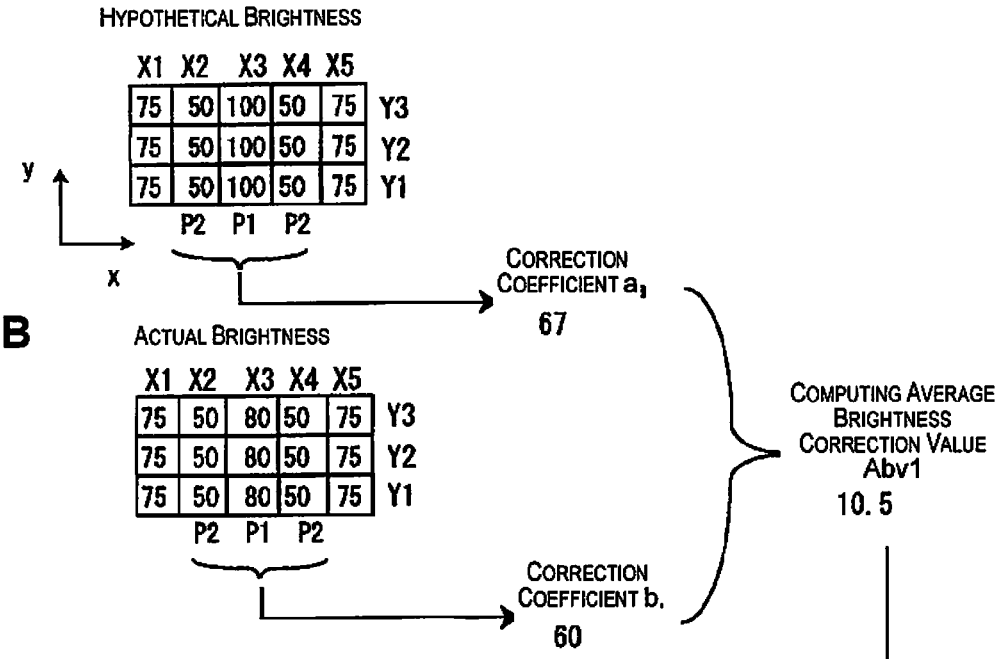

FIG. 9B shows the computing method of the average brightness correction value Abv1. In FIG. 9B, the position of each pixel included in the reference pixels is specified by a coordination of the x-direction and the y-direction. In FIG. 9B, the position of each pixel included in the reference pixels in the x-direction is identified by using x=Xh(h: 1 to m), and the position of each pixel in the y-direction is identified by using y=yj(j: 1 to n). The symbol "m" represents as the number of pixels that are arranged in the x-direction of the reference pixels, and in FIG. 9B, it is 5. Also, the symbol "n" represents the number of pixels that are arranged in the y-direction of the reference pixels, and in FIG. 9B, it is 3. Hereinafter, when (X3, Yj) is disclosed, it indicates each defective pixel P1 in the positions (X3, Y1), (X3, Y2), (X3, Y3) included in the reference pixels. Also, when (X2, Yj) is disclosed, it indicates each second pixel P2 in the positions (X2, Y1), (X2, Y2), (X2, Y3) included in the reference pixels. When (X4, Yj) is disclosed, it indicates each second pixel P2 of the positions (X4, Y1), (X4, Y2), (X4, Y3) included in the reference pixels. In addition, when (X1, Yj) is disclosed, it indicates the third pixel P3 in the positions (X1, Y1), (X1, Y2), (X1, Y3) included in the reference pixels. Further, when (X5, Yj) is disclosed, it indicates the third pixel P3 in the positions (X5, Y1), (X5, Y2), (X5, Y3) included in the reference pixels.

As the computing method of the average brightness correction value Abv1, the brightness of the defective pixels P1 included in the reference pixels changes to a hypothetical brightness presuming that the brightness becomes 100 (maximum brightness) due to the dot omission. In the reference pixels shown in the left upper side of FIG. 9B, the brightness of the defective pixels P1 is replaced to 100 in comparison with the reference pixels shown in the left lower side of FIG. 9B. At this point, the average brightness (correction coefficient a) of the defective pixels P1 and the second pixels P2 included in the reference pixels is computed by using the following Equation (1).

Equation (1)

$$\text{Correction coefficient } a = \frac{1}{3}\left(\frac{1}{n}\sum_{j=1}^{n} ip1_{(X3,Yj)} + \frac{1}{n}\sum_{j=1}^{n} p2_{(X2,Yj)} + \frac{1}{n}\sum_{j=1}^{n} p2_{(X4,Yj)}\right) \quad (1)$$

The brightness $ip1_{(X3,\ Yj)}$ is the hypothetical brightness of the defective pixels P1 in the position (X3, Yj) when the brightness presumes to become the brightest (100 in FIG. 9B) by the dot omission. Also, the brightness $p2_{(X2,\ Yj)}$ is the brightness value of the second pixels P2 in the position (X2, Yj) included in the reference pixels. Further, the brightness $p2_{(X4,\ Yj)}$ is the brightness value of the second pixel P2 in the position (X4, Yj) included in the reference pixels. In FIG. 9B, j represents the values from 1 to 3.

In Equation (1), an average brightness of the brightness $ip1_{(X3,\ Yj)}$, the brightness $p2_{(X2,\ Yj)}$, and the brightness $p2_{(X4,\ Yj)}$ included in each pixel line of the reference pixels is computed and the average brightness in each pixel line is averaged so as to provide the correction coefficient a. For example, the average brightness of the brightness $ip1_{(X3,\ Yj)}$ is 100, and when the average brightness of the brightness $p2_{(X2,\ Yj)}$ and the brightness $p2_{(X4,\ Yj)}$ are 50 respectively, by substituting the value into Equation (1), the correction coefficient a becomes 67 ((100+50+50)/3).

Next, the average brightness of the actual brightness of the defective pixels P1 included in the 5×3 reference pixels and the brightness of the second pixel P2 are computed as a correction coefficient b based on the following Equation (2).

Equation (2)

$$\text{Correction coefficient } b = \left(\frac{1}{n}\sum_{j=1}^{n} p1_{(X3,Yj)} + \frac{1}{n}\sum_{j=1}^{n} p2_{(X2,Yj)} + \frac{1}{n}\sum_{j=1}^{n} p2_{(X4,Yj)}\right) \quad (2)$$

The brightness $p1_{(X3,\ Yj)}$ is the actual brightness of each defective pixel P1 in the position (x3, yj) included in the reference pixels. In the lower side of FIG. 9B, j represents the values from 1 to 3. In Equation (2), an average brightness of the brightness $p1_{(X3,\ Yj)}$, the brightness $p2_{(X2,\ Yj)}$, and the brightness $p2_{(X4,\ Yj)}$ included in respective pixel lines of the reference pixels is computed and the average brightness of each pixel line is averaged so as to provide the correction coefficient b.

Therefore, when the average value of the brightness $p1_{(X3,\ Yj)}$ is 80 and the average brightness of the brightness $p2_{(X2,\ Yj)}$ is 50 respectively, by substituting each value into Equation (2), the correction coefficient a becomes 60 ((80+50+50)/3).

Next, an average brightness correction value Abv1 is computed by the following Equation (3) that the correction coefficient a and the correction coefficient b are used.

Equation (3)

$$\text{Average brightness correction value Abv1} = (b-a)\times 3/2 \quad (3)$$

The average brightness correction value Abv1 is a correction value that the brightness difference, which is changed before and after the correction, is allocated to two of the second pixels P2 that are positioned adjacent to each other. Therefore, the correction coefficient a is 67, and when the correction coefficient b is 60, by substituting each value into Equation (3), the average brightness correction value Abv1 becomes 10.5((67−60)×2/3).

Figure 9C:
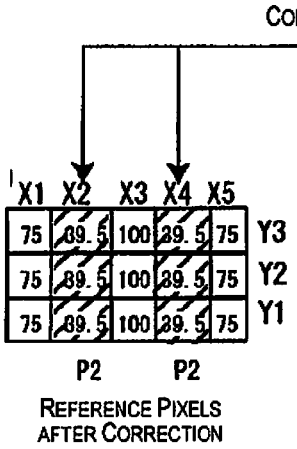

FIG. 9C is a diagram explaining a correction of the brightness of the second pixels P2 by using the average brightness correction value Abv1.

In Step S45, the image changing section 17*d* corrects the brightness of the second pixels P2 by using the average brightness correction value Abv1 (first brightness correction). For example, the values of the second pixels P2 are corrected by using the following Equation (4).

Equation (4)

$$\text{Brightness after correction } p\#2_{(Xh,Yj)} = \text{Brightness } p2_{(Xh,Yj)} - \frac{\text{Brightness } p2_{(Xh,Yj)}}{\text{Average Brightness } p2} \times Abv1 \quad (4)$$

The brightness after the correction $P\#2_{(Xh,\ Yj)}$ is the brightness after the correction of the second pixels P2 positioned in the position (Xh, Yj) of the reference pixels. In FIG. 9C, h represents 2 or 4. The average brightness p2 is an average value of the brightness in the position ((X2, Yj) or (X4, Yj)) belonging to the second pixels P2 which are the correction target. The first brightness correction is applied to the brightness of all of the second pixels P2 included in the reference pixels.

Therefore, when the brightness of the second pixels P2 is 50, the average brightness of 3 pixels lined in the y-direction is 50, and the average brightness correction value Abv is 10.5, by substituting each value into Equation (4), the brightness after the correction $P\#2_{(Xh,\ Yj)}$ becomes 39.5(50−1×10.5). In FIG. 9C, the brightness of all of the second pixels P2 positioned in (X2, Yj) and (X4, Yj) of the reference pixels is corrected from 50, which is shown in FIG. 9B, to 39.5.

Next, in Step S46, S47, the image changing section 17*d* performs the second density correction to the third pixels P3 which are positioned adjacent to the second pixels P2 included in the reference pixels (5×3). FIGS. 11A to 11C are diagrams explaining the second density correction. In the second density correction, based on the brightness change of the second pixels after the correction, by increasing the brightness of the third pixels P3, as a result, the density of the third pixels P3 is reduced.

In Step S46, the image changing section 17*d* computes the average brightness correction value Abv2 used for performing the second density correction. Here, the average brightness correction value Abv2 is the value that the difference (error) of the average brightness generated by the first density correction is reflected to one of the third pixels P3 which is positioned adjacent to the second pixels P2.

FIG. 11A shows a computing method of an average brightness correction value Abv2.

First, a correction coefficient c, which is the average brightness of the second pixels P2 after the correction included in each pixel line of the reference pixels and the third pixels P3, is computed by using the following Equation (5) and Equation (6).

Equation (5)

$$\text{Correction coefficient } c1 = \frac{1}{2}\left(\frac{1}{n}\sum_{j=1}^{n} p\#2_{(X2,Yj)} + \frac{1}{n}\sum_{j=1}^{n} p3_{(X1,Yj)}\right) \quad (5)$$

Equation (6)

$$\text{Correction coefficient } c2 = \frac{1}{2}\left(\frac{1}{n}\sum_{j=1}^{n} p\#2_{(X4,Yj)} + \frac{1}{n}\sum_{j=1}^{n} p3_{(X5,Yj)}\right) \quad (6)$$

The correction coefficient c (c1, c2) is calculated by computing the average brightness of the brightness ($p\#2_{(X2,\ Yj)}$, $p\#2_{(X4,\ Yj)}$) after the correction in any of the second pixels P2, which are positioned adjacent to the defective pixels p1, and the brightness ($p3_{(X1,\ Yj)}$, $p3_{(X5,\ Yj)}$) of the third pixels P3, which are positioned adjacent to each second pixel P2, and by averaging each average brightness so that the correction coefficient c is calculated.

That is, the correction coefficient c1 calculated by Equation (5) is the value computed with the brightness p #2$_{(X2,\ Yj)}$ after the correction of the second pixels P2 in the position (X2, Yj) of the reference pixels, and the third pixel brightness p3$_{(X1,\ Yj)}$ of the position (X1, Yj) which is positioned adjacent to the second pixels P2. Also, the correction coefficient c2 calculated by Equation (6) is the value computed with the brightness p #2$_{(X3,\ Yj)}$ after the correction of the second pixels P2 in the position (X3, Yj) of the reference pixels, and the third pixel brightness p3$_{(X5,\ Yj)}$ of the position (X5, Yj) which is positioned adjacent to the second pixels P2.

For example, when the average brightness of the brightness p #2 of the second pixel P2 after the correction is 39.5 and the average brightness of the brightness p3 of the third pixels is 75, by substituting each value into Equation (5) or Equation (6), the correction coefficient c becomes 57.25((39.5+75)/2).

Next, an average brightness of the second pixels P2 and the third pixels P3 before the correction included in each pixel line of the reference pixels is computed as a correction coefficient d by using the following Equations (7) and (8). The correction coefficient d is computed for the respective pixels lines of the third pixels P3 in the same manner as the correction coefficient c.

Equation (7)

$$\text{Correction coefficient } d1 = \frac{1}{2}\left(\frac{1}{n}\sum_{j=1}^{n} p2_{(X2,Yj)} + \frac{1}{n}\sum_{j=1}^{n} p3_{(X1,Yj)}\right) \tag{7}$$

Equation (8)

$$\text{Correction coefficient } d2 = \frac{1}{2}\left(\frac{1}{n}\sum_{j=1}^{n} p2_{(X4,Yj)} + \frac{1}{n}\sum_{j=1}^{n} p3_{(X5,Yj)}\right) \tag{8}$$

The correction coefficient d1 computed by Equation (7) is the value computed based on the brightness p2$_{(X2,\ Yj)}$ of the second pixels P2 in the position (X2, Yj) of the reference pixels and the brightness p3$_{(X1,\ Yj)}$ of the third pixels in the position (X1, Yj) that is positioned adjacent to the second pixels P2. Also, the correction coefficient d2 computed by Equation (8) is the value computed based on the brightness p2$_{(X4,\ Yj)}$ of the second pixels P2 in the position (X4, Yj) of the reference pixels and the brightness p3$_{(X5,\ Yj)}$ of the third pixels in the position (X5, Yj) that is positioned adjacent to the second pixels P2.

For example, when the average brightness of the second pixel P2 is 50 and the average brightness p3 of the third pixels P3 is 75, by substituting each value into Equation (7) or Equation (8), the correction coefficient d becomes 62.5(50+75)/2).

Next, an average brightness correction value Abv2 is computed by the following Equations (9) and (10) that the correction coefficient c and the correction coefficient d are used.

Equation (9)

$$\text{Average brightness correction value } Abv2_1 = (c_1 - d_1) \times 2 \tag{9}$$

Equation (10)

$$\text{Average brightness correction value } Abv2_2 = (c_2 - d_2) \times 2 \tag{10}$$

The average brightness correction value Abv2$_1$ is a correction value applied to the brightness of the third pixels P3 in the position (X1, Yj), and is computed based on c1 and d1. Also, the average brightness correction value Abv2$_2$ is a correction value applied to the brightness of the third pixels P3 in the position (X5, Yj) and is computed based on c2 and d2. For example, when the correction coefficient c is 57.25 and the correction coefficient d is 62.5, by substituting each value into Equation (9) or Equation (10), the average brightness correction value Abv2 becomes −10.5((57.25−62.5)×2).

FIG. 11B is a diagram explaining a correction of the brightness of the third pixels P3 by using the average brightness correction value Abv2.

In Step S47, the image changing section 17*d* corrects the brightness of the third pixels P3 by using the average brightness correction value Abv2 computed by such way. The following Equations (11) and (12) are the equation to correct the brightness of the third pixels P3.

Equation (11)

$$\text{Brightness after correction } p\#3_{(X1,Yj)} = \text{Brightness } p3_{(X1,Yj)} - \frac{\text{Brightness } p3_{(X1,Yj)}}{\text{Average Brightness } p3_{(X1,Yj)}} \times Abv2_1 \tag{11}$$

Equation (12)

$$\text{Brightness after correction } p\#3_{(X5,Yj)} = \text{Brightness } p3_{(X5,Yj)} - \frac{\text{Brightness } p3_{(X5,Yj)}}{\text{Average Brightness } p3_{(X5,Yj)}} \times Abv2_2 \tag{12}$$

The average brightness p3$_{(x1,\ Yj)}$ is the average brightness value of the third pixels in the position (X1, Yj). Also, the average brightness p3$_{(X5,\ Yj)}$ is the average brightness value of the third pixels in the position (X5, Yj). For example, when the brightness of the third pixels P3 is 75 and the average brightness correction value Abv2 is −10.5, by substituting each value into Equations (11) or (12), the brightness p #3 of the third pixels P3 after the correction becomes 85.5(75−1×(−10.5)). The second brightness correction is applied to all of the third pixels P3 included in the pixel lines in the reference pixels. In FIGS. 11A to 11C shown as an example, the average brightness correction value Abv2$_2$ is computed, and it is applied to the third pixels in the position (X5, Yj). By computing the average brightness correction value Abv2 in each row of the pixel lines and performing the correction of Equations (11) and (12), as shown in FIG. 11B, the brightness of all of the third pixels P3 included in the reference pixels is corrected from 75, which is shown in FIG. 11A, to 85.5. Therefore, the increment of the brightness of the second pixels P2 after the correction is reflected to the third pixels P3, which are positioned adjacent to it, and the brightness of the third pixels P3 is increased.

In Step S48, the brightness of each pixel included in the reference pixels is changed to the gradation value in reverse way. FIG. 11C shows the reference pixels that the value of each pixel was changed to the gradation value from the brightness. The changing method from the brightness of each pixel to the gradation value, in the same manner as Step S43, the look-up table or the well-known conversion equation can be used. In FIG. 11C, the gradation value of the second pixels P2, which are positioned adjacent to the defective pixels P1, is increased from 127 to 154 by the first density correction and the second density correction, and the gradation value of the third pixels P3, which are positioned adjacent to the second pixels P2, is reduced from 75 to 50.

Further, since the correction is performed to fall the brightness change of the halftone into a predetermined range in before and after the correction, the image deterioration due to the dot omission can be suppressed while the brightness change by the correction is suppressed in minimum.

When all of the reference pixels that includes the defective pixels P1 are not reviewed (Step S49: NO), it proceeds to Step S50, and the image changing section 17*d* changes the reference pixels. It returns to Step S41, and repeats a series of processes.

On the other hand, when all of the reference pixels are reviewed (Step S49: YES), the image changing section 17*d* proceeds to Step S5 of FIG. 6.

On the other hand, in Step S42, when the Duty value of the reference pixels is less than the threshold value T1 (Step S42: NO), the image changing section 17*d* proceeds to Step S50 without performing the density correction processing to the reference pixels. When the Duty value is less than the threshold value T1, the reference pixels are a light image that the dot omission is made less noticeable. Therefore, the density correction is not performed to the reference pixels.

Returning to FIG. 6, in Step S5, the halftone processing section 17*c* performs the halftone processing to the image data after the density correction. The detailed method of the halftone processing is not specified. The halftone processing section 17*c* may execute the halftone processing by dithering that the dither mask preliminary stored in, for example, a predetermined memory (e.g., ROM 14) is used, or it may execute the halftone processing by using an error diffusion method.

The halftone that specifies to form dot (dot ON) or does not form dot (dot OFF) in every pixel is generated by the halftone processing. In FIG. 7B, a dot is formed in a pixel that "2" is given, and a dot is not formed in a pixel that "0" is given. When it is configured by the ink amount data of four colors of C, MY, K, the halftone in response to each color is generated.

In Step S6, the ejection control section 17*e* performs a rearrangement processing in the order of transferring the halftone after changing the dot size to the print head 20. According to the rearrangement processing, for each dot specified by the halftone, it determines which nozzle 21 is used in the nozzle array and when it is formed in response to a pixel position and an ink type. According to the raster data (one example of the halftone) after the rearrangement processing, the ejection control section 17*e* executes the ejection of dots from each nozzle 21 by sequentially transferring it to the print head 20. Therefore, an image is reproduced on a print substrate based on the halftone.

The halftone processing section 17*c* may be in charge of the steps from the state of the aforementioned vector data to the halftone (rasterize processing, color conversion processing, and halftone processing).

Figure 12:
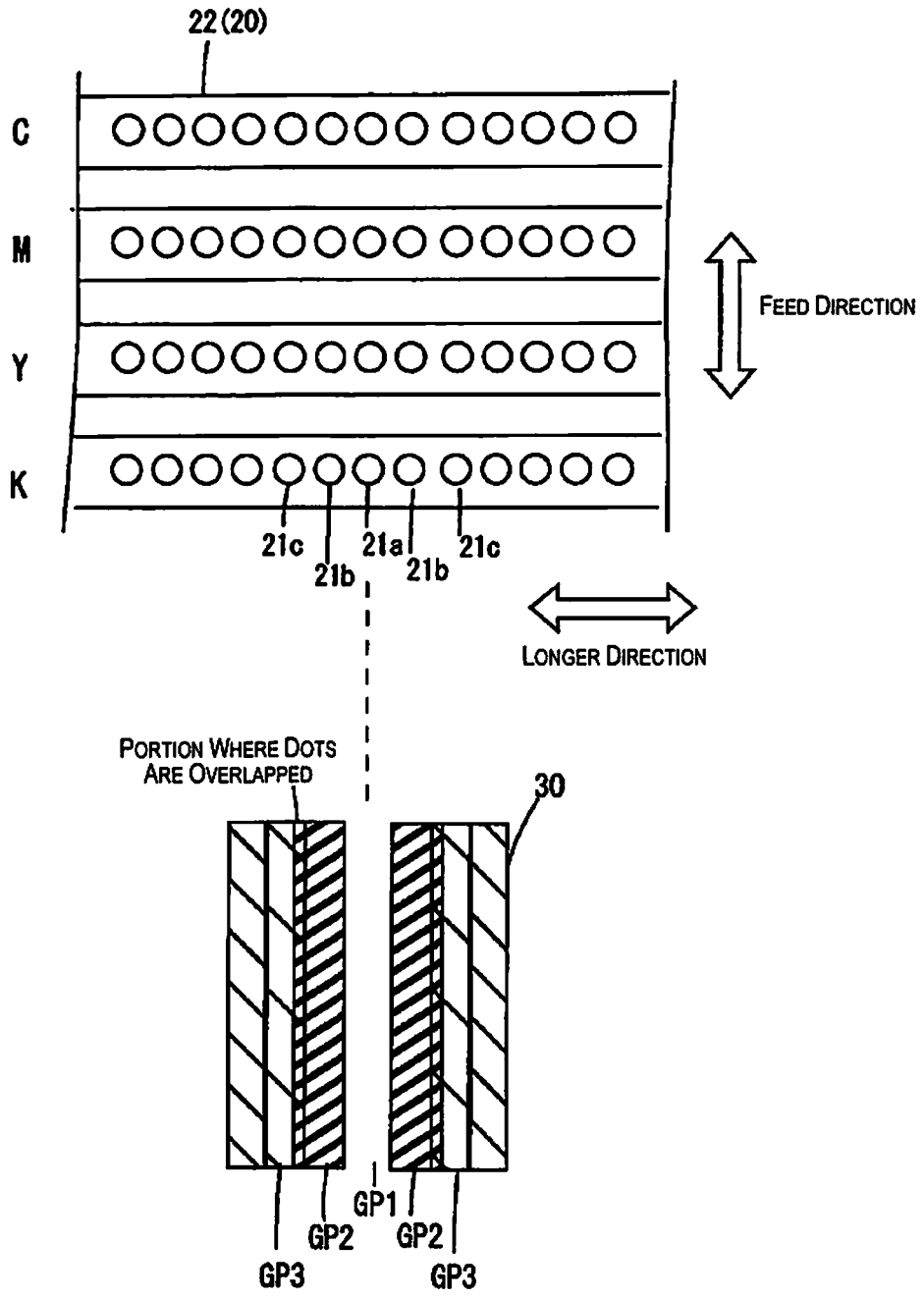
FIG. 12 is a diagram showing dots printed by the printer 10.

FIG. 12 is a diagram showing dots printed by the printer 10. Also, in FIG. 12, the nozzle 21*a* is the defective nozzle that exhibits defective ejection of ink.

The ejection of ink from the defective nozzle 21*a* performs abnormally so that the dot omission occurs in the imaging section GP1. Also, since the density of the imaging section GP1, which are positioned adjacent to the imaging section GP1 in the longer direction where the dot omission occurs, is high, the printing position of the dots is overlapped to the imaging section GP1. As a result, the dot omission in the imaging section GP1 is made less noticeable.

Here, when the density of the imaging section GP2 is high, there is a case that the dots overlap to the imaging section GP3 side which is positioned adjacent the imaging section GP2 in the longer direction so that the density unevenness occurs in the portion where the dots are overlapped and the portion where the dots are not overlapped. However, in the present embodiment, the density of the imaging section GP3 is reduced so that the overlapping of the dots is suppressed in near the boundary between the imaging section GP2 and the imaging section GP3. Therefore, the dot omission occurring in the imaging section GP1 becomes less noticeable by forming the dots in the imaging section GP2, and the density unevenness occurring between the imaging section GP2 and the imaging section GP3 can be reduced. As a result, the image quality deterioration of the image can be suppressed.

Further, in a case of a light image that the density of the designated image data is lower than the value (threshold value T1), it presumes that the graininess is deteriorated by increasing the density. Therefore, in a case of the light image, the deterioration of the graininess can be suppressed by not performing the density correction.

Other than that, a plurality of threshold values that determine the Duty value is provided so that the content of the density correction may be changed depending on the comparison result between the threshold values.

2. Second Embodiment

Up to here, it was explained to presume that the printer 10 is provided with the print head 20 as a head for line-type printer. However, the printer 10 is provided with the print head 20 being movable in the scanning axis direction, which is defined in a direction intersecting with the aforementioned feed direction, and that is, it may be a serial printer.

Figure 13:
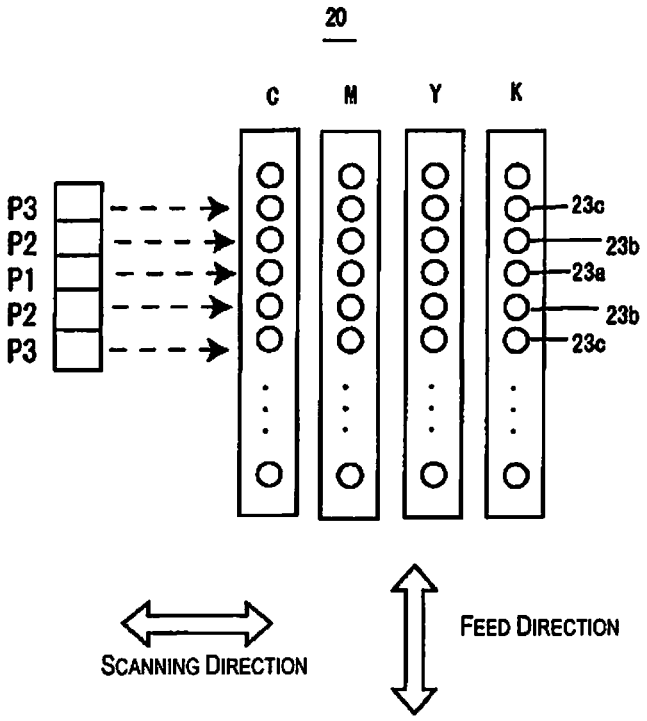
FIG. 13 is a diagram showing the print head 20 as a head for serial printer.

FIG. 13 is a diagram showing the print head 20 as a head for serial printer.

In the print head 20, a nozzle array of each color of C, M, Y, K is provided with a plurality of nozzles 23 that is respectively arranged in the feed direction. Therefore, in the second embodiment, the fourth nozzles 23*b*, which are positioned adjacent to the defective nozzle 23*a*, are positioned adjacent to the defective nozzle 23*a* in the feed direction. Also, the fifth nozzles 23*c*, which are adjacent to the fourth nozzles 23*b*, are positioned in an opposite side of the defective nozzle 23*a* with respect to the fourth nozzles 23*b* in the feed direction. Therefore, in the designated image data, the second pixels P2 are the pixels printed by the fourth nozzles 23*b*. Also, the third pixels P3 are the pixels printed by the fifth nozzles 23*c*.

With such configuration, a dot omission in a direction intersecting the feed direction is made less noticeable so that an image quality can be improved in the serial printer.

3. Various Modified Examples

Modified Example 1

The position information that the position determination section 17*a* acquires is not limited to the information supplied from the head internal detection unit 18. For example, a position of a nozzle, in which the defect ejection occurs, may be inputted as the position information by controlling the control panel 15 by the user. In this case, the user controls the printer 10 to print a solid image of each color of, for example, C, M, Y, K. The user observes the solid image and determines a pixel line in which the dot omission occurs. Based on the pixel line that was determined, the user controls the control panel 15 to input the position of the defective nozzle as the position information to the printer 10 so that it is possible that the printer 10 determines the position of the defective pixels P1.

With such configuration, even though the printer 10 is not provided with the head internal detection unit 18, the present invention can be applied.

Further, even though it is a thermal printer in which the head internal detection unit 18 cannot detect a residual vibration of the pressure generating element 34, the dot omission can be made less noticeable.

Modified Example 2

A switching condition of the density correction processing may be set depending on an ink type (pigment, dye) or a type of a print substrate. It is generally well-known that the dye ink is easily bled on a print substrate in comparison with the pigment ink. Also, in the type of a print substrate, it is well-known that the ink is easily bled in a cardboard in comparison with a printing paper or a coated paper. Therefore, when the ink or the print substrate used in the printer 10 that the dots are easily bled is used, the image changing section 17*d* reduces the degree of density changes. Here, as a method that the image changing section 17*d* determines the ink or the paper used in the printer 10, the user preliminary inputs a type of the used ink or print substrate through the UI screen so that the inputted result may be determined.

With such configuration, the occurrence of deterioration in an image due to the bleeding of ink can be suppressed while the dot omission is made less noticeable Modified Example 3

Up to here, it was explained in the case that each processing was executed by the printer 10. However, at least a part of the processing may be executed in the PC 40 side. For example, the printer driver 41 generates a halftone in which the density was changed in accordance with the program, and the halftone is outputted to the printer 10. The printer 10 may execute a printing in response to the halftone.

Also, in the liquid used in the printer 10 in the present specification, other than the ink, any liquid can be applied if it is the liquid or the fluid that the viscosity is changed due to the evaporation of the fluid or the solvent.

As a specific example of the print substrate used in the printer 10, it includes flat sheet, roll paper, paperboard, paper, non-woven, fabric, ivory, asphalt paper, art paper, color board, color quality paper, inkjet paper, Senkashi for printing, printing paper, printing paper A, printing paper B, printing paper C, printing paper D, India paper, printing tissue paper, Japanese tissue paper, back carbon paper, airmail paper, sanitary paper, embossed paper, OCR PAPER, offset paper, cardboard paper, chemical fiber paper, processed paper, drawing paper, pattern paper, one side luster Kraft paper, wallpaper base, spinning paper, paper string base paper, pressure-sensitive copying paper, photosensitive paper, thermal paper, Ganpishi, can board, yellow paperboard, imitation leather paper, ticket paper, functional paper, cast coated paper, Kyohanashi, Japanese vellum, metalized paper, metal foil paper, glassine, gravure paper, Kraft paper, Kraft extensible paper, Kraft ball, crepe paper, lightweight coated paper, cable insulating paper, decorative base paper, base paper for building material, Kent paper, polishing paper, synthetic paper, synthetic fiber paper, coated paper, capacitor paper, miscellaneous paper, woody paper, bleached Kraft paper, diazo photosensitive paper, paper tube base paper, magnetic recording paper, cardboard for paper container, dictionary paper, light-proof paper, unglazed shipping sacks Kraft paper for heavy-duty sack, pure white roll paper, security paper, Shoji paper, high-quality paper, communication paper, food container base paper, book paper, calligraphy paper, white paper board, white ball, newspaper wrapping paper, blotting paper, water-soluble paper, drawing paper, ribbed Kraft paper, laid paper, speaker cone paper, electrostatic recording paper, napkin paper, cellulose wadding paper, laminate base paper, gypsum board base paper, bond paper base paper, semi-high-quality paper, cement bag paper, ceramic paper, solid fiber board, tarred felt base paper, tarpaulin paper, alkali-proof paper, fireproof paper, acid-proof paper, greaseproof paper, paper towel, Danshi, cardboard, corrugated base paper, map paper, chip ball, medium quality paper, neutral paper, Chirigami, mat art paper, tea bag paper, tissue paper, electrical insulation paper, Tengujo, laminated paper, transfer paper, toilet paper, statistical machine card paper, stencil base paper, coated printing paper, coated paper base paper, Torinoko paper, tracing paper, corrugating medium, napkin base paper, flame-retardant paper, NIP PAPER, tag paper, adhesive paper, carbonless paper, release paper, brown paper, Baryta paper, paraffin paper, wax paper, vulcanized fiber, Japanese writing paper, PPC PAPER, writing paper, fine-coated printing paper, form paper, continuous slip paper, copy base paper, pressboard, moisture-proof paper, Hosyosi, waterproof paper, non-tarnish paper, packaging paper, bond paper, manila board, Mino paper, Shoingami, milk carton paper, imitation Japanese vellum, oiled paper, Yoshinogami, rice paper, cigarette paper, liner, liner board, parchment paper, unglazed shipping sacks Kraft paper, roofing paper, filter paper, Japanese paper, Varnished paper, wrapping paper, lightweight paper, air-dried paper, wet strength paper, ashless paper, acid-free paper, unfinished paper or paperboard, two-layered paper or paperboard, three-layered paper or paperboard, multi layer paper or paperboard, unsized paper, sized paper, wove paper, woodgrain paper or paperboard, machine finished paper or paperboard, machine-glazed paper or paperboard, plate-glazed paper or paperboard, friction-glazed paper or paperboard, calendared paper or paperboard, supercalendared paper, lamin (paper or paperboard), one side colored paper or paperboard, both sides colored paper or paperboard, twin-wire paper or paperboard, rag paper, all-rag paper, mechanical pulp paper or paperboard, mix straw pulp paper or paperboard, water-finished paper or paperboard, chip ball, coupled chip ball, millboard, glazed millboard, solid board, mechanical pulp board, brown mechanical pulp board, brown mixed pulp board, imitation leather board, asbestos board, felt board, brown tar paper, water leaf paper, surface size paper, press pan, press paper, wrinkle-finished paper, laminated ivory, blade coated paper, coated paper roll, gravure coated paper, size press coated paper, brush coated paper, air knife coated paper, extrusion coated paper, dip coated paper, curtain coated paper, hot melt coated paper, solvent coated paper, emulsion coated paper, bubble coated paper, imitation art paper, bible paper, poster paper, packaging tissue, base paper, carbon base paper, diazo photosensitive paper base paper, photographic printing paper base paper, frozen food grade paper base paper: for direct contact paper, frozen food grade paper base paper: for non-contact paper, safety paper, banknote paper, insulating paper or paperboard, laminated insulation paper, electrical insulating paper for cable, paperboard for shoe sole, paper for textile paper tube, Jacquard card or paperboard, board for pressing, binder's board, suitcase board, matrix paper, recording paper, Kraft liner, certified liner, Kraft faced liner, waste paper liner, envelope paper, paper board for folding box, paper board for coated folding box, paper board for bleached pulp backing folding box, typewriter paper, stencil copying paper, spirit copying paper, calendar roll paper, Cartridge paper, paper for corrugated processing, corrugated processing paper, two layer tar paper, two layer tar reinforcing paper, cloth patch of paper or paperboard, cloth core paper or paperboard, reinforcing paper or reinforcing paper board, laminated paper board, carton compact, top layer, pulp molded article, wet crepe, index card, carbon paper, multi-copy form paper, back carbon form paper, carbonless form paper, envelope, postcard, pictorial postcard, postal letter, pictorial postal letter, etc., and specifically, for the functional paper, it is not limited to the plant fiber, and the materials such as inorganic, organic, metal fiber, etc. are widely used so that a high functionality is applied in the manufacture of paper and the steps of processing, and it includes the materials to be used in the advanced areas such as, mainly, information, electronics, medicals, etc., but it is not limited to them.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An inkjet printer comprising:

a print head including a plurality of nozzles to eject ink;

a nozzle position specifying section configured to specify a position of a first nozzle of the plurality of nozzles that exhibits defective ejection of the ink; and a print control section configured to eject the ink from the plurality of nozzles based on image data, the print control section being configured to determine a density of second pixels, which are positioned adjacent to first pixels to be printed by the first nozzle that was specified, and a density of third pixels, which are positioned adjacent to the second pixels except the first pixels, based on the image data, and to correct to increase the density of the second pixels and to reduce the density of the third pixels.

2. The inkjet printer according to claim 1, wherein the inkjet printer is a line-type printer, the second pixels are included in a pixel line printed by the second nozzle, which is positioned adjacent to the first nozzle in a direction intersecting a feed direction of a print substrate, and the third pixels are included in a pixel line printed by the third nozzle, which is positioned adjacent to the second nozzle in a direction intersecting the feed direction of the print substrate.

3. The inkjet printer according to claim 1, wherein the inkjet printer is a serial printer, the second pixels are included in a pixel line printed by the third nozzle, which is positioned adjacent to the first nozzle in a feed direction of a print substrate, and the third pixels are included in a pixel line printed by a fourth nozzle, which is positioned adjacent to the third nozzle in the feed direction of the print substrate.

4. The inkjet printer according to claim 1, wherein the print control section is configured to perform correction of the density for every predetermined number of pixels included in the image data.

5. The inkjet printer according to claim 4, wherein the print control section is configured to correct the density of the second pixels and the density of the third pixels to become a condition that a difference between an average brightness of the predetermined number of pixels before the correction and an average brightness of the predetermined number of pixels after the correction when the first pixels are defined as high brightness is less than a predetermined range.

6. A method of printing wherein a print head including a plurality of nozzles to eject ink is used, the method comprising:

specifying a position of a first nozzle in the plurality of nozzles that exhibits defective ejection of ink; and ejecting the ink from the plurality of nozzles based on image data, the ejecting of the ink including determining a density of second pixels, which are positioned adjacent to first pixels to be printed by the first nozzle that was specified, and a density of third pixels, which are positioned adjacent to the second pixels except the first pixels, based on the image data, and correcting the density of the second pixels to be increased and correcting the density of the third pixels to be reduced.

* * * * *